United States Patent [19]

Moore

[11] Patent Number: 4,678,252

[45] Date of Patent: Jul. 7, 1987

[54] ELECTRICAL CONNECTOR FOR CIRCUIT BOARDS

[75] Inventor: Larry V. Moore, Richardson, Tex.

[73] Assignee: Rockwell International Corporation, El Segundo, Calif.

[21] Appl. No.: 866,650

[22] Filed: May 27, 1986

[51] Int. Cl.[4] ..... H01R 9/09

[52] U.S. Cl. ..... 439/62; 439/630; 439/326

[58] Field of Search ..... 339/17 L, 17 LM, 17 M, 339/75 MP, 176 MP

[56] References Cited

U.S. PATENT DOCUMENTS 3,701,071 10/1972 Landman ..... 339/17 M
3,795,888 3/1974 Nardo et al. ..... 339/176 MP
3,920,303 11/1975 Pittman et al. ..... 339/176 MP
4,084,874 4/1978 Georgopulos ..... 339/75 MP

*Primary Examiner*—Neil Abrams
*Attorney, Agent, or Firm*—Bruce C. Lutz; V. L. Sewell; H. Fredrick Hamann

[57] ABSTRACT

An electrical connector and an apparatus for providing staging of electrical connections between a motherboard and a daughterboard is disclosed. An angled insulator having first and second legs forms a pie-shaped cavity for receiving one edge of a printed circuit board. The first leg forms a fulcrum about which the printed circuit board is rotated until it abuts an alignment surface of an electrically insulating stiffener formed in the second leg. A second connector is used for providing staging of electrical connections. Protective end caps prevent the insertion of a printed circuit board until it is properly aligned.

10 Claims, 9 Drawing Figures

ELECTRICAL CONNECTOR FOR CIRCUIT BOARDS

TECHNICAL FIELD

This invention relates to electrical connectors and more particularly to an electrical connector for receiving a printed circuit board or the like.

Connectors for receiving printed circuit boards have become common. In particular, it has become common practice to mount printed circuit board connectors on a large board known as a "motherboard". A printed circuit board known as a "daughterboard" is inserted into each of the connectors so that one motherboard will host several daughterboards.

BACKGROUND ART

The most common prior art involves the connection of daughterboards at a right angle to a motherboard forming a "cage", but it is also known to connect the daughterboards so that they are parallel to the motherboard. In such an arrangement, it is common to have both a primary connector connected to one end of the daughterboard and a secondary connector at the opposite end. It is frequently desirable to connect the daughterboard to the primary connector first and then to the secondary connector, a practice known as "staging". This would be true in situations where power staging is desired in order to insure that the daughterboard is first connected to power and ground before making other connections or for other reasons.

One electrical connector for printed circuit boards is shown in U.S. Pat. No. 4,185,882. It provides one type of connector in which a daughterboard can be connected parallel to the motherboard. The particular arrangement mates the electrical spring contact with the face of the daughterboard which is facing away from the motherboard. The spring contacts provide some force for holding the daughterboard in place, but unfortunately the springs are exposed when the daughterboard is in place. The spring contacts are exposed to an even greater extent when no daughterboard is inserted. Such exposure increases the likelihood that a spring contact will be bent or otherwise damaged.

DISCLOSURE OF INVENTION

In accordance with the present invention, an electrical connector for a printed circuit board includes an angled insulator having first and second legs which form a pie-shaped cavity at their meeting point. The cavity extends for a distance necessary to receive one edge of the printed circuit board. The cavity is such that the printed circuit board can be moved through an arc commencing with a position parallel to the first leg. Flexible electrical contacts form a portion of the first leg so that electrical contact portions of the printed circuit board make contact with the resilient electrical contacts when the printed circuit board is in the position parallel to the first leg. The second leg forms an alignment surface for abutting the surface of the printed circuit board opposite the electrical contacts, and the first leg forms a fulcrum about which the printed circuit board is pivoted.

A protective end cap is located at each end of the plurality of spring contacts. The end caps extend out from the alignment surface and the fulcrum so that the edge of the printed circuit board cannot be inserted between the alignment surface and the fulcrum except when the printed circuit board is also properly aligned and inserted between the end caps.

These and other objects, advantages and features of this invention will be apparent from the following description taken with reference to the accompanying drawing, wherein is shown the preferred embodiments of the invention.

BRIEF DESCRIPTION OF DRAWING

For a full understanding of the nature and objectives of the present invention, reference should be made to the following detailed description taken in connection with the drawing wherein.

BEST MODE FOR CARRYING OUT THE INVENTION

Figure 1:
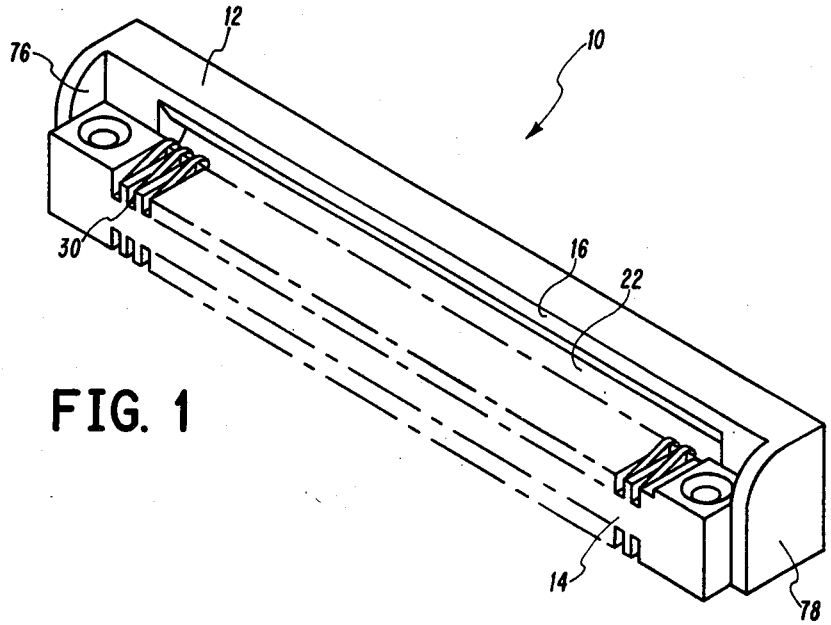
FIG. 1 is a perspective view of an electrical connector in accordance with the present invention.
Figure 2:
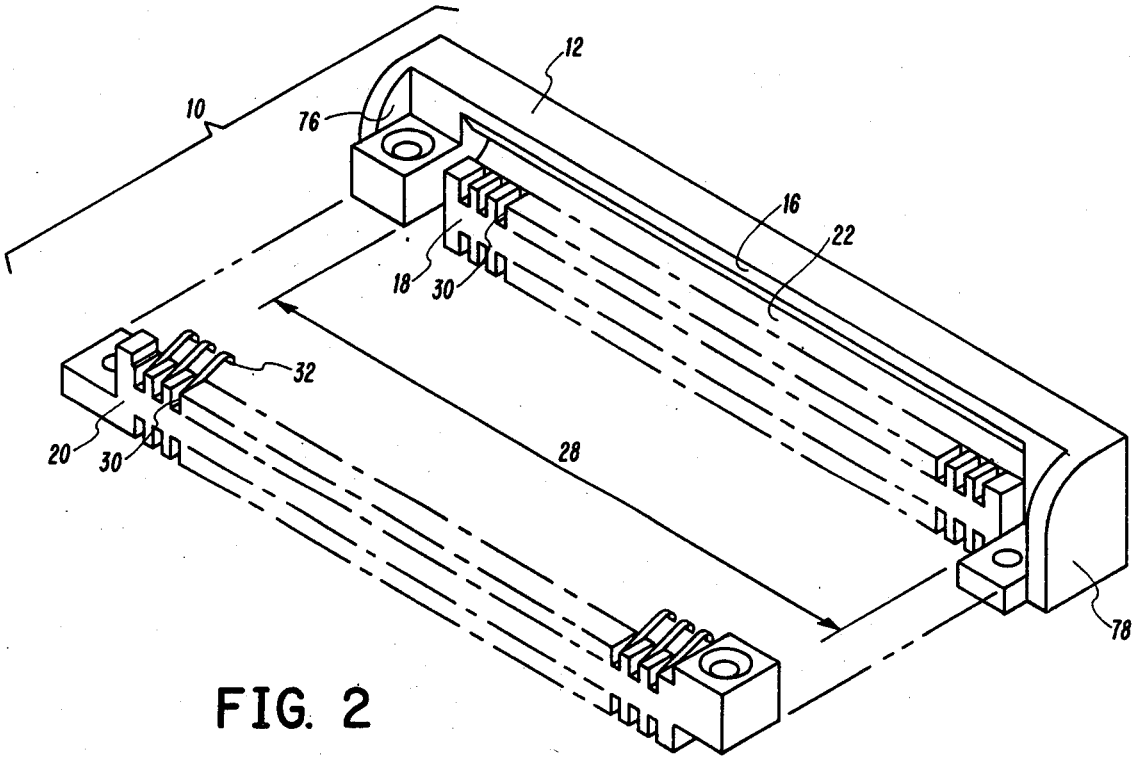
FIG. 2 is a partially exploded view of the connector of FIG. 1.

Referring now to the drawing, and in particular to FIG. 1 and FIG. 2, an electrical connector according to the present invention is referred to generally by reference numeral 10. Electrical connector 10 includes an angled insulator 12 having first and second legs 14 and 16 respectively. First leg 14 can be conveniently constructed from two members 18 and 20 which interlock in a manner conventional for electrical connectors and well known in the art.

Figure 3:
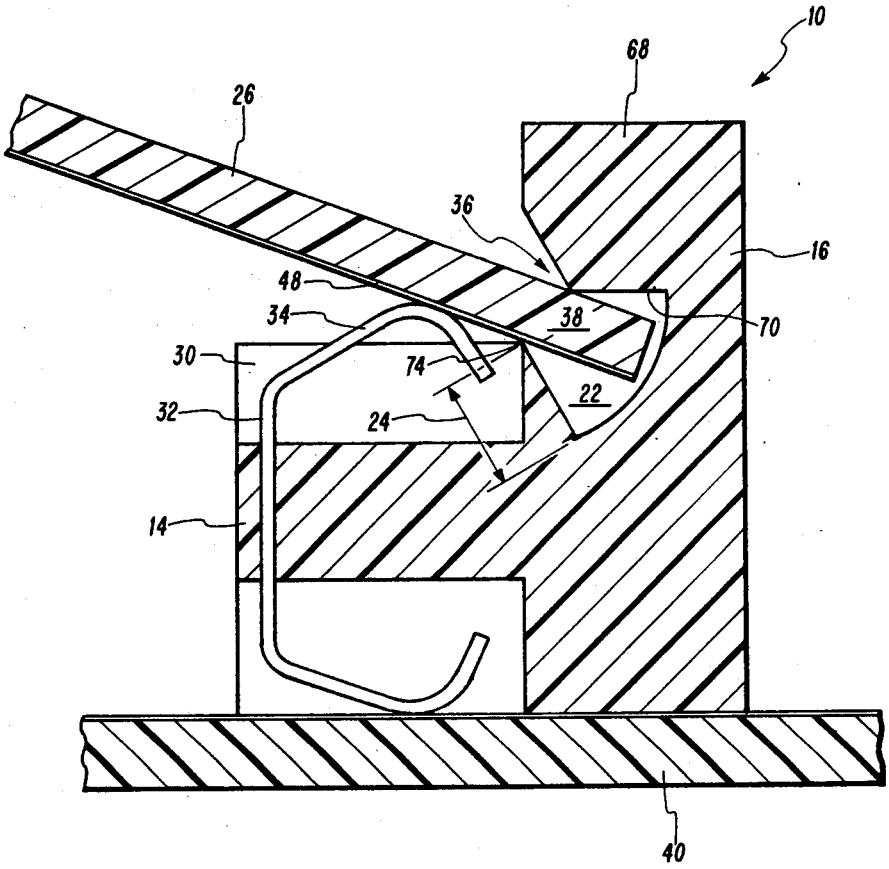
FIG. 3 is a cross sectional view of a connector according to the present invention mounted on a motherboard and receiving a daughterboard.

Referring also to FIG. 3, angled insulator 12 forms a cavity 22 in the shape of a pie-wedge at the meeting point of first leg 14 with second leg 16. Pie-shaped cavity 22 forms a mouth 36 and extends for a distance 24 necessary to receive one edge 38 of a printed circuit board 26, sometimes known as a "daughterboard", inserted into the cavity. Angled insulator 12 has a predetermined length 28 at right angles to legs 14 and 16 for receiving a given width of printed circuit board 26. The given width of printed circuit board 26 would be at right angles to FIG. 3 and is not illustrated.

First leg 14 forms a plurality of transverse recesses 30 along its length. A plurality of resilient electrical contacts 32 are generally arranged in the plurality of recesses 30. Normally, in an unstressed condition, resilient electrical contacts 32 have a substantial portion 34 extending above the surface of first leg 14.

Figure 4:
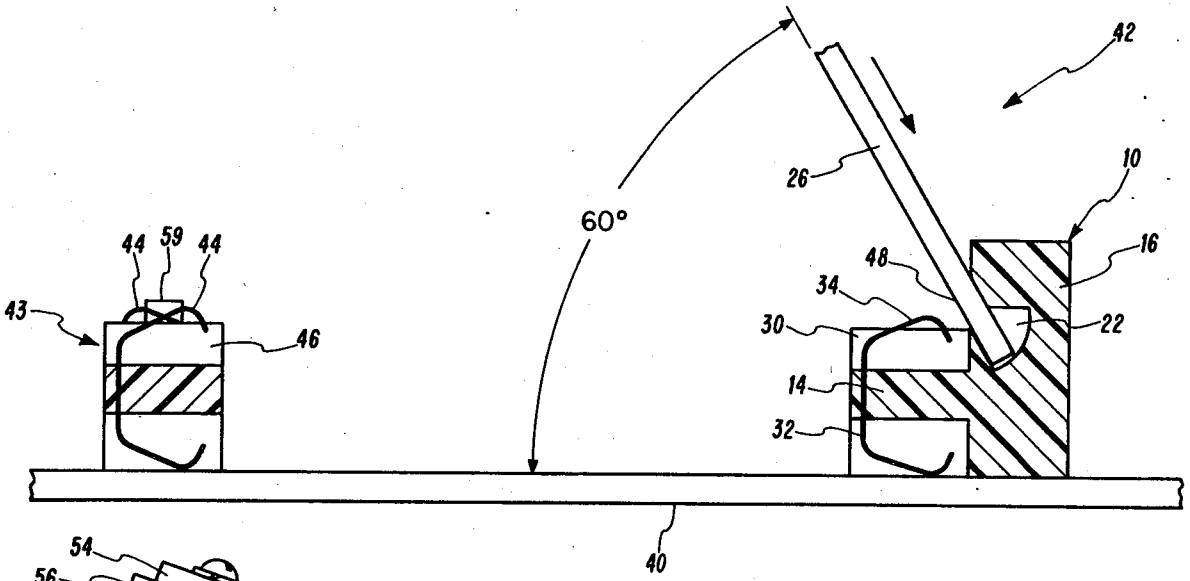
FIG. 4 is a cross sectional view of an apparatus according to the present invention for providing staging of electrical connections between a primary connector, a secondary connector and a daughterboard in the initial insertion position.
Figure 5:
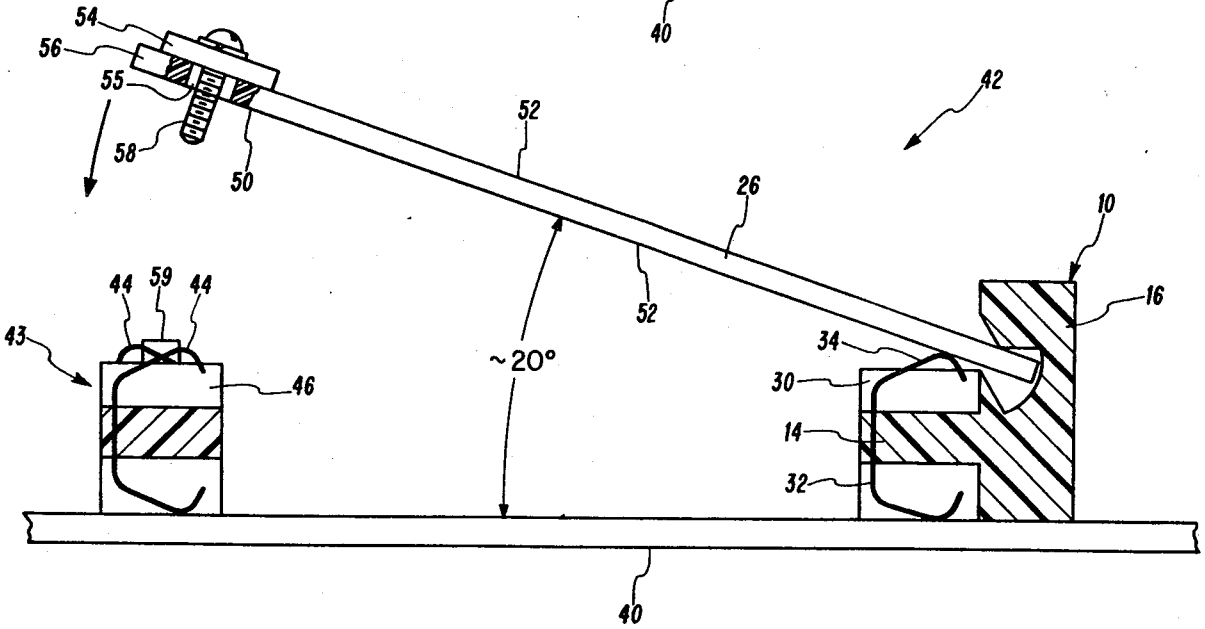
FIG. 5 is a cross sectional view similar to that of FIG. 4 of an apparatus according to the present invention for providing staging of electrical connections and a daughterboard having made electrical contact with the primary connector.
Figure 6:
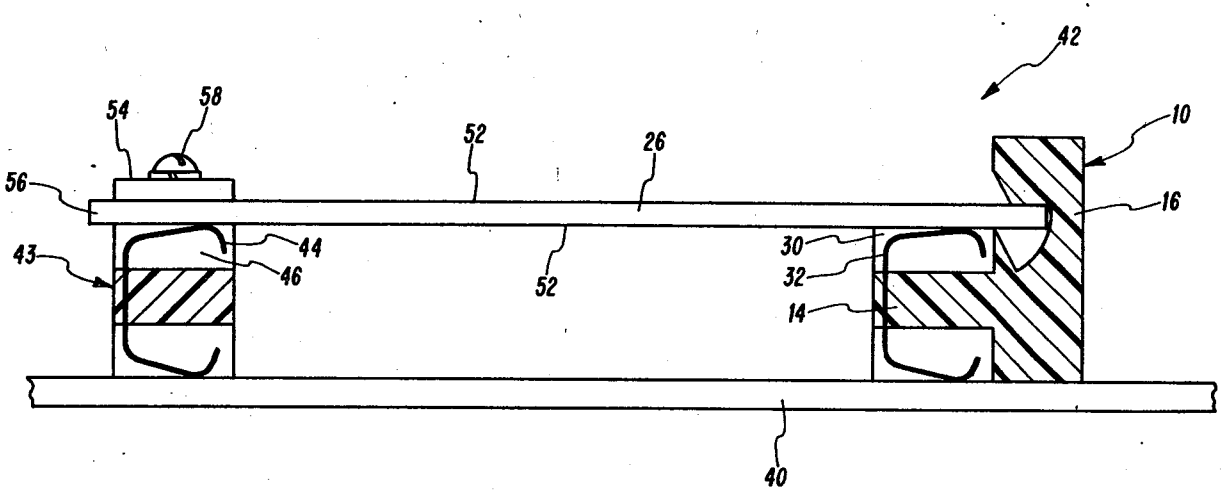
FIG. 6 is a cross sectional view similar to that of FIG. 4 and FIG. 5 showing the daughterboard fully connected and in electrical contact with both the primary connector and the secondary connector.

Referring now to FIG. 4 through FIG. 6, an apparatus for providing staging of electrical connections between a motherboard 40 and daughterboard 26 is referred to generally by reference numeral 42. Apparatus 42 includes electrical connector 10 which serves as a first or primary electrical connector means. A second electrical connector 43 is also mounted on motherboard 40. Second electrical connector 43 includes a plurality of resilient electrical contacts 44 arranged in a plurality of recesses 46 distributed along the length of the second electrical connector.

Daughterboard 26 includes at least two sets of generally planar electrical contact portions 48 and 50 for mating with plurality of resilient electrical contacts 32 and 44 respectively. Plurality of electrical contacts 48 and 50 also form sets of electrical connections to circuity 52 located on the two surfaces of daughterboard 26.

Figure 7:
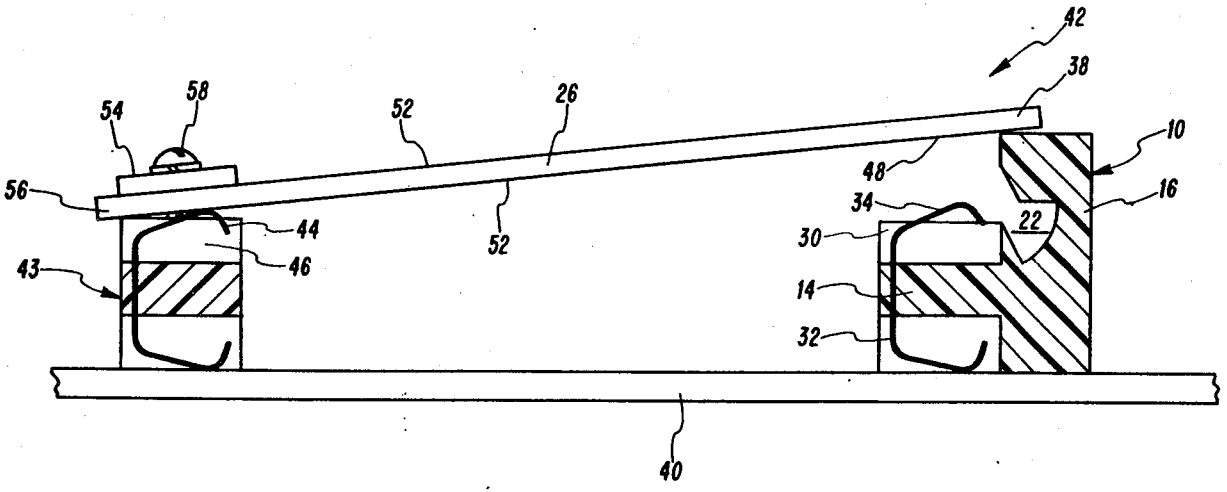
FIG. 7 is a cross sectional view similar to that of FIG. 4 of an apparatus according to the present invention for providing staging of electrical connections and a daughterboard which was connected to the secondary connector prior to being connected to the primary connector.

Daughterboard 26 also includes a stiffener 54 along edge 56 and a threaded fastener 58 inserted through stiffener 54 and a precision opening 55 of edge 56 for threadingly engaging second electrical connector 43, thus preventing daughterboard electrical connections from becoming electrically connected with the resilient electrical contacts except through movement of the daughterboard in a direction which acts to compress the resilient electrical contacts. Second electrical connector 43 includes a registration post 59 which is received by precision opening 55 to insure proper alignment of daughterbord 26 with electrical contacts 34 and 44. As more specifically illustrated in FIG. 7, threaded fastener 58 threadingly engaging second electrical connector 43 prior to insertion of edge 38 into cavity 22 prevents electrical connections 48 from making contact with resilient electrical connectors 34.

As shown more specifically in FIG. 4, daughterboard 26 must be inserted into cavity 22 at a substantial angle such as the 60 degree angle to motherboard 40 as illustrated. Referring also to FIG. 5, in the particular example illustrated, after daughterboard 26 is inserted into cavity 22 and moved through an arc toward a position parallel with motherboard 40, electrical contact is made between contacts 48 on the daughterboard and resilient electrical contacts 32 at approximately a 20 degree angle with respect to the motherboard and first leg 14. In a preferred form, such contact would be made by at least approximately 15 degrees. Daughterboard 26 can then be moved further through an arc to be parallel with first leg 14 as illustrated in FIG. 6.

Figure 8:
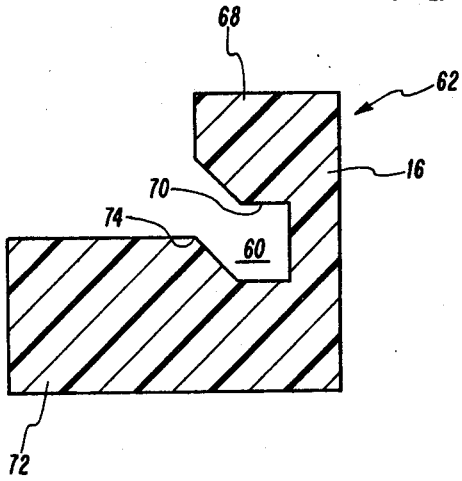
FIG. 8 is a cross sectional view of an alternative embodiment of the present invention.
Figure 9:
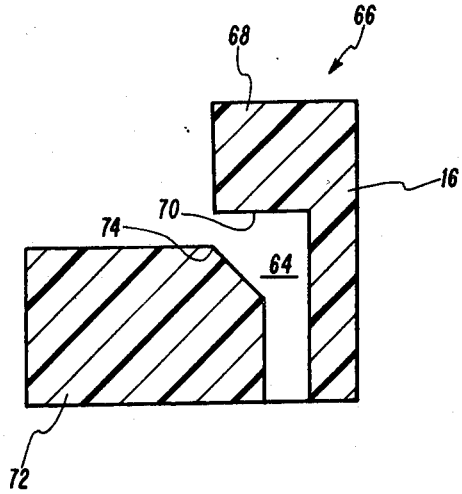
FIG. 9 is a cross sectional view of yet another alternative embodiment of a connector according to the present invention.

Referring now to FIGS. 3, 8 and 9, it now can be seen that the cavity for insertion of edge 38 of daughterboard 26 needs to include a pie-wedge shape for the movement of daughterboard 26 through an arc motion, but, in fact, the cavity can take on any larger shape as shown by cavity 60 of electrical connector 62 and cavity 64 of electrical connector 66. Each of the electrical connectors illustrated does, however, include an electrically insulating stiffener 68, forming an alignment surface 70 for abutting the surface of daughterboard 26 opposite electrical contact portions 48, where electrically insulating stiffener 68 is one portion of second leg 16 as illustrated. The electrical connectors also include an electrically insulating base member 72. It can thus be seen that edge 38 of daughterboard 26 can be inserted between fulcrum 74 and alignment surface 70. Daughterboard 26 can be moved through an arc about fulcrum 74 until the plurality of electrical contact portions 48 make contact with the plurality of resilient electrical contacts and the surface of the daughterboard opposite the electrical contact portions abuts the alignment surface.

Referring once again to FIG. 1 and FIG. 2, an electrical connector according to the present invention also includes in one arrangement at least two protective end caps 76 and 78 located on each end of plurality of resilient electrical contacts 32 and extending out from first leg 14 and second leg 16, therefore, also extending out from the alignment surface and the fulcrum, so that the edge of a printed circuit board or the like cannot be inserted into cavity 22 except when it is also inserted between the end caps.

Daughterboards are typically made of a fiberglass material and have dimensions in the order of 0.060 plus or minus 0.005 inches. Motherboards are also typically fiberglass. The clearance between alignment surface 70 and fulcrum 74 in a direction perpendicular to motherboard 40 should be such that the minimum clearance is substantially equal to the maximum thickness of a daughterboard. Thermal plastic has been found to be one suitable construction material for stiffener 54.

It can now easily be seen that the present invention provides controlled horizontal movement of connector resilient contacts since the movement of the contacts is almost entirely in a direction perpendicular to the motherboard. Contact deformation is thus reduced. Providing a built-in stiffener 68 minimizes mechanical leverage for forces acting on the connector and the mounting hardware as well as reducing the number of mounting holes in the motherboard and the connector. Under normal circumstances, plurality of resilient contacts 32 have sufficient stiffness to lift daughterboard 26, preventing contact with the secondary connector until such contact is deliberately made by someone inserting the daughterboard.

Unlike some connectors in the prior art, the present invention provides pin protection when the daughterboard is in its operational position. The pins, plurality of resilient electrical contacts 32, are covered by the daughterboard. Use of the present connector allows both sets of connector pads to be on the same side of the daughterboard, simplifying construction of the daughterboards as well as providing more easily tested daughterboards. Testing is also simplified for the assembled motherboards, before the daughterboards are inserted, since vertical access to the lever-block contacts is available.

From the foregoing it will be seen that this invention is one well adapted to attain all the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the figures of the accompanying drawing is to be interpreted as illustrative and not in a limiting sense.

What is claimed is:

1. Electrical connector apparatus for use with a printed circuit board of a given width and a predetermined thickness and having electrical contacts on one surface near an edge to be inserted into the electrical connector apparatus comprising, in combination:

(a) angled insulator means having first and second legs and a predetermined length at right angles to the legs;

(b) a pie-shaped cavity in said insulator means at the meeting point of said two legs with the cavity extending for a distance necessary to receive the printed circuit board, the pie-shaped cavity being such that the edge of a printed circuit board inserted into said cavity can be moved through an arc of at least 15 degrees terminating with a position parallel to said first leg;

(c) flexible electrical contact means forming a portion of said first leg and extending above the surface thereof, the dimensions of said cavity and the electrical contact means being such that a printed circuit board being inserted into said cavity must be inserted at an angle of approximately at least 15 degrees with respect to said first leg and then moved through an arc to be parallel with said first leg whereby good electrical contact is made between electrical contacts on the one surface of the printed and said flexible electrical contact means of said electrical connector apparatus.

2. Apparatus as claimed in claim 1 wherein: second leg of said angled insulator means being of a thickness such that the electrical contacts of said printed circuit board cannot electrically contact said flexible electrical contact means unless said printed circuit card is inserted into said cavity.

3. Lever block connector apparatus for use with a printed circuit board of a given width and having electrical contact means spaced apart and adjacent but not extending quite to at least one edge of said board comprising, in combination:

(a) dielectric means comprising a base portion and a back portion forming an L-shape and having a printed circuit board electrical connection axis substantially parallel with said base portion, said base portion further including a plurality of recesses on the upper surface thereof and arranged along the length thereof;

(b) a plurality of resilient electrical contact means generally arranged in said plurality of recesses but normally, in an unstressed condition, having a substantial portion thereof extending above the surface of said base portion;

(c) cavity means in said back portion of dielectric means forming a mouth for receiving the one edge of a printed circuit board, the cavity being of such a shape that the board may not be inserted directly therein along said connection axis due to the presence and extension above the upper surface of said base portion of the purality of resilient electrical contact means while permitting the board to be inserted into the cavity at an angle intermediate said base and back portions and then, using surfaces of the cavity as a fulcrum point, the board may be lowered to be parallel to said connection axis while simultaneously stressing said resilient electrical contact means such that most of said electrical contact means no longer extends above the surface of said base portion.

4. Apparatus for providing staging of electrical connections between motherboard mounted electrical connectors and a printed circuit daughterboard having at least two sets of electrical connections in widely separated areas comprising, in combination:

(a) motherboard means;

(b) daughterboard means including at least a first set and a second set of electrical connections in widely separated areas, the first set being situated inwardly from a first edge of said daughterboard means;

(c) a first electrical connector means mounted on said motherboard means, said first connector means including a receiving cavity for receiving said first edge of said daughterboard at an angle with respect to the surface of said motherboard, resilient electrical contact means forming a part of said first electrical connector means and juxtaposed said cavity acting to prevent the insertion of said first edge of said daughterboard when said daughterboard is positioned parallel to the surface of said motherboard, said resilient electrical contact means providing electrical contact and deforming from their normal position as the daughterboard is moved from said cavity inserted angle to a position parallel to said motherboard;

(d) a second electrical connector means, including resilient electrical contact means, mounted on said motherboard means a distance from said first electrical connector means such that the second set of electrical connections makes contact with said resilient electrical contact means thereof when said first edge of said daughterboard is fully inserted into said cavity.

5. Apparatus as claimed in claim 4 wherein said second electrical connector means further includes registration post means to prevent said daughterboard electrical connections from becoming electrically connected with said resilient electrical contact means of the second electrical connector except through movement of said daughterboard means in a direction which acts to compress said resilient electrical contact means.

6. Apparatus as claimed in claim 4 wherein said second electrical connector means further includes positioning means to prevent said daughterboard electrical connections from becoming electrically connected with said resilient electrical contact means of the second electrical connector except through movement of said daughterboard means in a direction substantially perpendicular to the surface of said motherboard.

7. Lever block connector apparatus for providing an electrical interconnection between a motherboard and a daughterboard comprising, in combination:

(a) a dielectric leg comprising a base means for mechanical attachment to the motherboard and a receiving cavity in a back portion thereof for receiving an edge of the daughterboard;

(b) a dielectric first member including a plurality of recesses along the length thereof and further including at least one projection means on one side thereof for mating with the cavity of said leg to determine the size and shape of said cavity as an assembled connector and to assure registration therewith;

(c) a dielectric second member; and (d) a plurality of resilient contact means attached to the dielectric second member, each having a distal portion which, when said first and second members are juxtaposed, are arranged in separate recesses of said first dielectric member whereby electrical contact between contact means is prevented wherein the leg, the first member and the second member combine to form connector means for receiving a daughterboard only at an angle to a surface thereof designed for attachment to a motherboard whereby electrical contact is made by lever action between the cavity and the resilient contact means to reposition the daughterboard substantially parallel with the motherboard.

8. Lever block connector apparatus for providing an electrical interconnection between a motherboard and a daughterboard comprising, in combination:

(a) a unitary dielectric leg comprising a base means for mechanical attachment to the motherboard forming a receiving cavity in a back portion thereof for receiving an edge of a daughterboard, having a motherboard attachment axis and first member including a portion forming a plurality of recesses along the length thereof;

(b) a dielectric second member; and (c) a plurality of resilient contact means each having a distal portion which, when said unitary leg and first member and the second member are juxtaposed, are arranged in separate recesses of said first member whereby electrical contact between contact means is prevented, said electrical contact means providing contact between said motherboard and said daughterboard wherein the unitary leg and first member combines with the second member to form connector means for receiving a daughterboard only at an angle to a surface thereof designed for attachment to a motherboard whereby electrical contact is made by lever action between the receiving cavity and the resilient contact means to reposition the daughterboard substantially parallel with the attachment axis.

9. An electrical connector for use with a circuit board having a predetermined thickness and having a plurality of generally planar electrical contact portions on one surface near an edge to be inserted into the electrical connector, comprising in combination:

(a) an electrically insulating stiffener forming an alignment surface for abutting the surface of the circuit board opposite the electrical contact portions;

(b) an electrically insulating base member forming a fulcrum wherein the edge of the circuit board can be inserted between the fulcrum and the alignment surface;

(c) a plurality of resilient electrical contacts extending through the base member wherein the edge the circuit board can be moved through an arc about the fulcrum until the plurality of electrical contact portions of the circuit board make contact with the plurality of resilient electrical contacts and the surface of the circuit board opposite the electrical contact portions abuts the alignment surface.

10. An electrical connector according to claim 9 further including at least two protective end caps, at least one of the protective end caps located on each end of the plurality of resilient electrical contacts and extending out from the alignment surface and the fulcrum so that the edge of the circuit board cannot be inserted between the alignment surface and the fulcrum except when the circuit board is also inserted between the end caps.

* * * * *